US009051896B2

(12) United States Patent
Haug

(10) Patent No.: US 9,051,896 B2
(45) Date of Patent: Jun. 9, 2015

(54) STEEL PISTON FOR INTERNAL COMBUSTION ENGINES

(75) Inventor: Tilmann Haug, Weissenhorn (DE)

(73) Assignee: Daimler AG, Stuttgart (DE)

( * ) Notice: Subject to any disclaimer, the term of this patent is extended or adjusted under 35 U.S.C. 154(b) by 224 days.

(21) Appl. No.: 13/390,717

(22) PCT Filed: Sep. 3, 2010

(86) PCT No.: PCT/EP2010/005417

§ 371 (c)(1),
(2), (4) Date: Feb. 16, 2012

(87) PCT Pub. No.: WO2011/038823

PCT Pub. Date: Apr. 7, 2011

(65) Prior Publication Data

US 2012/0174899 A1 Jul. 12, 2012

(30) Foreign Application Priority Data

Oct. 2, 2009 (DE) ..... 10 2009 048 124

(51) Int. Cl.

| | |
|---|---|
| ***F02F 3/00*** | (2006.01) |
| ***C22C 38/02*** | (2006.01) |
| ***C22C 38/40*** | (2006.01) |
| ***C22C 38/58*** | (2006.01) |
| *F02F 3/02* | (2006.01) |

(52) U.S. Cl.

CPC ..... *F02F 3/0084* (2013.01); *F05C 2201/021* (2013.01); *F02F 3/0092* (2013.01); *F02F 3/02* (2013.01); *F02F 3/00* (2013.01); *C22C 38/02* (2013.01); *C22C 38/40* (2013.01); *C22C 38/58* (2013.01); *F05C 2201/0448* (2013.01); *F05C 2251/042* (2013.01)

(58) Field of Classification Search

CPC ..... F02F 3/0084; F02F 3/0092; F02F 3/00; F02F 3/02; F05C 2201/0448; F05C 2251/042; F05C 2201/021; C22C 38/02; C22C 38/40; C22C 38/58

USPC ..... 123/193.6, 193.5, 193.4; 92/224, 227; 29/888.042

See application file for complete search history.

(56) References Cited

U.S. PATENT DOCUMENTS 2,255,006 A * 9/1941 Graham ..... 92/227
5,775,892 A * 7/1998 Miyasaka et al. ..... 418/55.2

(Continued)

FOREIGN PATENT DOCUMENTS

| | | | |
|---|---|---|---|
| DE | 19953311 | A1 | 6/2000 |
| DE | 10244513 | A1 | 4/2004 |
| DE | 102006030699 | A1 | 1/2008 |
| DE | 102007021101 | A1 | 11/2008 |
| EP | 1612395 | A1 | 1/2006 |
| JP | 58224153 | A | 12/1983 |
| JP | 61126357 | A | 6/1986 |
| JP | 01116052 | A | 5/1989 |
| JP | 02296075 | A | 6/1990 |
| JP | 04002702 | A | 1/1992 |
| JP | 08014098 | A | 1/1996 |
| JP | 2001234806 | A | 8/2001 |
| JP | 2003090432 | A | 3/2003 |
| WO | 2006048153 | A1 | 5/2006 |
| WO | 2007136130 | A1 | 11/2007 |
| WO | 2008000347 | A2 | 1/2008 |
| WO | 2009069762 | A1 | 6/2009 |

OTHER PUBLICATIONS

Office Action issued Mar. 14, 2014, in Japanese Patent Application No. 2012-531256 (with English-language translation).

*Primary Examiner* — Marguerite McMahon
(74) *Attorney, Agent, or Firm* — Patent Central LLC; Stephan A. Pendorf

(57) ABSTRACT

A steel piston with a piston upper part (12) with combustion chamber recess (11) and ring wall (5), and with a piston lower part (13) with piston body or piston skirt and with connecting rod bearing (8) for internal combustion engines with cylinder crankcases made of lightweight metal alloys, with at least the piston lower part consisting of a steel alloy which has a coefficient of thermal expansion in the range from 13 to 20×10−6 1/K.

7 Claims, 1 Drawing Sheet

(56) References Cited

U.S. PATENT DOCUMENTS

| | | | | |
|---|---|---|---|---|
| 5,816,211 | A | 10/1998 | Atmur et al. | |
| 6,244,161 | B1 * | 6/2001 | Myers et al. | 92/224 |
| 6,691,666 | B1 | 2/2004 | Berr et al. | |
| 7,503,304 | B2 | 3/2009 | Otsuka et al. | |
| 8,001,947 | B2 | 8/2011 | Ando et al. | |
| 8,820,288 | B2 * | 9/2014 | Kaiser et al. | 123/193.6 |
| 2003/0084567 | A1 * | 5/2003 | Dickmann et al. | 29/888.061 |
| 2009/0178640 | A1 | 7/2009 | Haug et al. | |
| 2009/0266330 | A1 * | 10/2009 | Brower et al. | 123/193.5 |
| 2010/0037765 | A1 | 2/2010 | Gniesmer et al. | |
| 2010/0253006 | A1 | 10/2010 | Ishikawa et al. | |
| 2012/0037113 | A1 * | 2/2012 | Scharp et al. | 123/193.6 |
| 2012/0222305 | A1 * | 9/2012 | Scharp et al. | 29/888.042 |

* cited by examiner

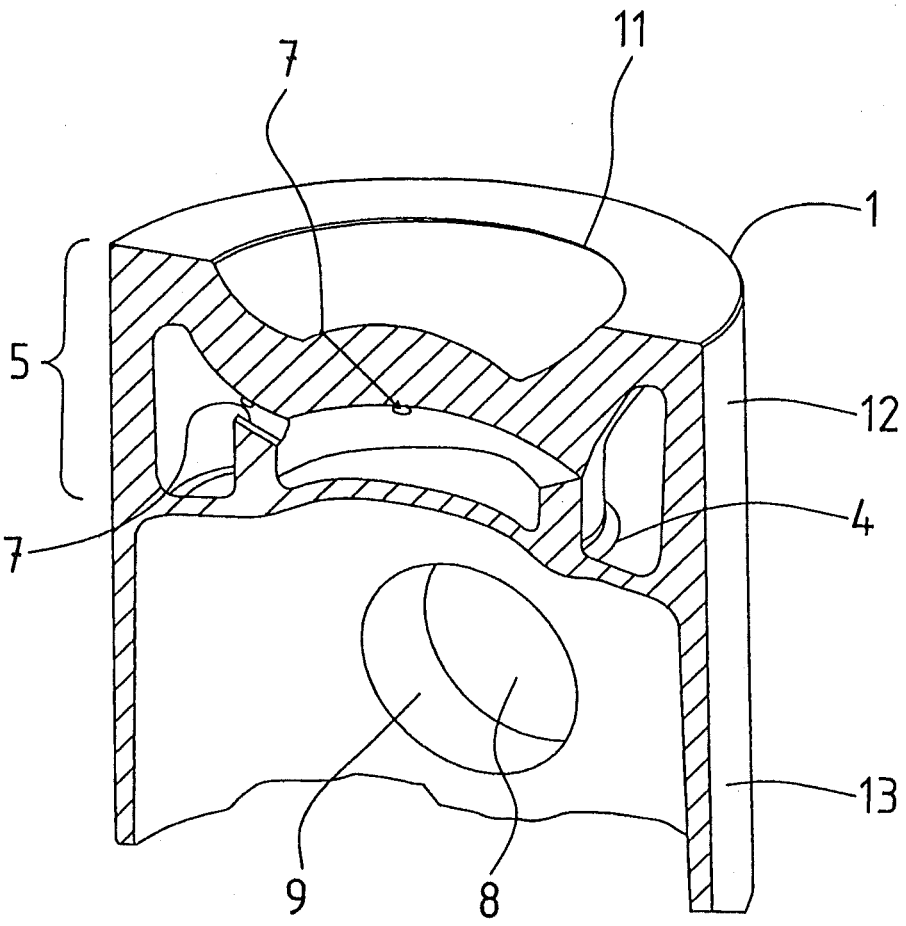
11
7
1
5
12
4
7
13
9
8

STEEL PISTON FOR INTERNAL COMBUSTION ENGINES

The invention relates to steel pistons for internal combustion engines, and to internal combustion engines with steel pistons, and to internal combustion engines with steel pistons and a cylinder crankcase made of lightweight metal.

Owing to the increasing demands of highest possible peak pressures in reciprocating internal combustion engines of up to 250 bar, the lightweight aluminum pistons frequently used are increasingly reaching their performance limits. This applies in particular to diesel engines. Therefore, increasingly steel pistons are again being demanded for the heavy vehicle sector, but also for the passenger car sector. Here, the fundamentally higher strength of steels is utilized.

The use of steel pistons is known in principle, with different steel compositions and manufacturing methods being described. For example, a method for the production of a multipart cooled piston is known from DE 102 44 513 A1. The piston upper part is manufactured from heat resistant steel, and the piston lower part from forged PFP steel (precipitation hardened ferritic/pearlitic steel). The subsequent joining or connecting of the annular rib of the piston upper part to the supporting rib of the piston lower part takes place by means of a welding or soldering process.

It is proposed in EP 1 612 395 A1 to cast the entire piston from steel. In particular the following steel compositions (in mass percent) are suitable as casting alloys: C≤0.8%, Si≤3%, Mn≤3%, S≤0.2%, Ni≤3%, Cr≤6%, Cu≤6%, Nb 0.01-3%, remainder Fe with inevitable impurities, or C≤0.1-0.8%, S≤3%, Si≤3%, Mn≤3%, S≤0.2%, Ni≤10%, Cr≤30%, Cu≤6%, Nb≤0.05-8% and remainder Fe with inevitable impurities. Here, in particular the good room-temperature yield strength and a high high-temperature tensile strength and breaking strength are of importance.

A steel piston for internal combustion engines is likewise known from DE 10 2006 030 699 A1 which consists of a reduced-density steel alloy of the composition in % by weight Mn: 12-35, Al: 6-16, Si: 0.3-3, C: 0.8-1.1, Ti: up to 0.03, remainder Fe and unavoidable steel accompanying elements, or of a high grade steel alloy of the composition in % by weight Mn: 3-9, Si: 0.3-1, C: 0.01-0.03, Cr: 15-27, Ni: 1-3, Cu: 0.2-1, N: 0.05-0.17, remainder Fe and unavoidable steel accompanying elements.

When the known steel pistons are used in cylinder crankcases made of lightweight metals, the difference in the thermal expansions of steel and lightweight metals however results in particular problems. The piston body or also the piston skirt, which represents the portion which to a greater or lesser extent encompasses the lower part of the piston, takes over the straight guidance of the piston in the cylinder. It can only fulfill this function if there is sufficient play relative to the cylinder. Owing to sufficient skirt length and narrow guidance, what is called the piston rocking upon the changing of contact of the piston from one cylinder wall to the opposite one (secondary piston movement) is kept low. Since the lightweight metal alloys, in particular Al alloys, suitable for cylinder crankcases have a significantly higher coefficient of thermal expansion (CTE or $\alpha$) than steels, during operation of the internal combustion engines there are clear differences in the thermal expansion. In such case, problems of piston guidance occur during operation, which can make itself felt, inter alia, by noise generation, such as rattling. The piston noise, which is one of the main causes of the noise generation of the crankgear in the internal combustion engine, is prompted first and foremost by the lateral piston forces (piston slap). Owing to the rapidly changing lateral piston force, the piston is pushed from one side of the cylinder barrel on to the other side. When the engine is cold and with lightweight metal pistons, this effect makes itself felt particularly clearly as piston knock. Measures for improving piston guidance through the skirt and measures for reducing piston rocking are therefore acoustically effective.

The problem of the invention is therefore to provide steel pistons with improved piston guidance for internal combustion engines with lightweight metal cylinder crankcases.

This problem is solved according to the invention by providing an internal combustion engine with steel pistons piston with a piston upper part and with a piston lower part and with a cylinder crankcase (engine block) made substantially of an aluminum alloy, and by a method for providing such an engine, described below.

It is thus of particular significance to the invention that high grade steels which have a particularly high coefficient of thermal expansion (CTE), or a CTE which is as close as possible to that of aluminum alloys or lightweight metal alloys for cylinder crankcases, be used for the piston. This reduces the play in operation with which the piston can be pushed from one side of the cylinder barrel onto the other side by the changing lateral piston force. According to the invention, provision is thus made for at least the piston lower part to consist of a steel alloy which has a coefficient of thermal expansion (CTE) in the range from 13 to $20\times10^{-6}$/K. Unless otherwise indicated, in this case this is always to be understood to mean the CTE at 20° C. or the CTE at room temperature.

The particularly suitable high grade steels include in particular steel alloy with a coefficient of thermal expansion in the range from 16 to $19\times10^{-6}$/K.

Taking into account the CTE at room temperature of Al alloys which are conventional in cylinder crankcases of approximately 19 to $25\times10^{-6}$/K, with the selected high grade steels very good equalization of the thermal expansion in lightweight metal cylinder crankcases can be achieved. The gap between the cylinder barrel and piston, or piston body or piston skirt, at operating temperature can thereby be considerably reduced. This applies in particular also to aluminum cylinder crankcases with integrally cast cylinder liners or running surfaces made from sprayed layers, since the CTE of the cylinder crankcase is only very slightly adversely influenced by the latter.

The piston lower part in this case comprises the piston body or the piston skirt. In diesel pistons, what is called the smooth-skirt piston with its closed skirt which is interrupted only in the region of the piston pin bores is preferred. The embodiments of the piston skirts in pistons for spark-ignition engines are more versatile. For reasons of weight, owing to the higher speeds, their skirt form is only limited to relatively narrow skirt surfaces. Typical forms of construction are full slipper pistons, window-type pistons and asymmetrical pistons with running surfaces of different widths.

With the selected high grade steels with a high CTE, also very good equalization can be carried out on cylinder crankcases which are constructed from gray cast iron, or which have gray cast iron bushings or gray cast iron cylinder liners. One configuration of the invention thus comprises the combination of a steel piston with a CTE in the range from 13 to $16\times10^{-6}$/K and a cylinder crankcase made of gray cast iron or a cylinder crankcase with gray cast iron bushings.

The high grade steels with a high CTE (coefficient of thermal expansion) according to the invention are particularly preferably selected from high grade steels with a Cr content of 15-26% and an Ni content of 8-15%. Unless otherwise designated, in this case the content is always to be understood to be in weight % or mass %.

Particularly preferably, the Cr content is 17 to 20% and the Ni content is 9 to 13%.

Ni contents close to the indicated upper limit, in particular 11 to 13%, are particularly suitable.

In addition to the high coefficients of thermal expansion, also a high tensile strength and breaking elongation is required of the suitable high grade steel alloys. On one hand, the piston body or the piston skirt should absorb the lateral forces without deforming or starting to crack, and on the other hand it should adapt elastically to the deformations of the cylinder. Preferably, therefore, high grade steels are selected which have tensile strengths above 500 $N/mm^2$ and breaking elongations above 35%.

The particularly suitable high grade steels with a high CTE include steels with the following fundamental alloying constituents (in mass %):

C: 0.05 to 0.15; Si: max. 1.0; Mn: 1 to 3; Cr: 15 to 20; Mo: max. 4; Ni: 8 to 13, N: max. 0.15 and remainder Fe. Particularly suitable are the high grade steels of the following designations or DIN names: X5CrNi 18-10, DIN 1.14301, X2CrNi 19-11, DIN 1.4306, X2CrNi 18-9, DIN 1.4307, X2CrNiMo 17-12-2 or DIN1.4404.

Likewise, also the high grade steels with the following fundamental alloying constituents (in mass %) are particularly suitable:

C: 0.2 to 0.45; Si: 1.5 to 1.75; Mn: 0.5 to 1.0; Cr: 18 to 22; Ni: 10.5 to 14; remainder Fe. Particularly suitable are the high grade steels of the following designations or DIN names: GX40CrNiSi 27-4, DIN 1.4832, GX40CrNiSi 22-10 or DIN 1.4826.

In a first configuration according to the invention, the steel piston is constructed in one part from a single steel alloy with a high CTE. In particular a casting process, such as for example a low pressure casting process, is used as the production process. Preferably in this case the cooling duct is also cast by suitable core processes.

Likewise, it is possible to construct the piston in several parts from the same or alternatively from different steel alloys with a high CTE. In this case, in particular those production variants in which the piston upper part, which also comprises the piston ring grooves, is forged are advantageous. As a rule, the piston upper part with cooling duct can be produced more economically by forging than by casting. Therefore, built-up pistons with a forged upper part made from a steel alloy with a high CTE and a cast lower part made from a steel alloy with a high CTE are particularly preferred.

Depending on the design of the piston and the castability or forgeability of the selected steel alloy with a high CTE, however, also both parts may be forged or both parts may be cast.

The conventional methods, in particular welding, induction welding, friction welding, or laser welding, may be used in order to connect the two parts.

Surprisingly, it has been shown that the selection of a steel with adapted CTE for the piston lower part relative to the piston upper part is of decisive importance. With optimum configuration of the piston lower part, less high demands have to be made on the piston upper part. The piston lower part in this case is typically made larger, or longer, than the upper part. Unlike the piston upper part, as a rule it also does not bear any sealing rings or piston rings or the like. With the known piston designs, the piston is generally guided in the region of the piston skirt, or piston body. However, pistons are also known which are guided both in the region of the piston skirt and in the region of the piston upper part. In order to attain the goal of reducing the pressure drop and preventing noise generation, it is therefore of particular significance that the steel alloy with a high CTE is used in the region of the piston guidance.

In a further configuration according to the invention, only the piston lower part, comprising the piston body or piston skirt, is formed from a steel alloy with a high CTE. Since the comparatively lower thermal conductivity of the high grade steels may be a disadvantage, since overheating of the combustion chamber recess or the entire piston may occur, also multipart pistons with different material properties adapted to the upper part and lower part can be produced. In this case, only one of the two parts consists of a steel alloy with a high CTE. Thus the steel piston is of two-part or multipart construction. In such case, a distinction has to be made between the piston upper part with combustion chamber recess and ring wall and the piston lower part with piston skirt and connecting rod bearing.

In a preferred two-part or multipart embodiment, the piston upper part has a wear-resistant alloyed heat treatment steel. Since the selected steel alloys for the lower part have only comparatively low thermal conductivities, preferably also steels with higher thermal conductivity are of significance for the piston upper part. The particularly suitable steels of the piston upper part include in particular steels from the group MoCr4, 42CrMo4, CrMo4, 31CrMoV6 or 25MoCr4. The choice of material for the two-part or multipart embodiment is nevertheless not restricted to steels for the piston upper part.

The piston upper part and piston lower part can be joined together by welding or soldering processes. Particularly preferred are friction welding, induction welding, or laser welding.

The invention will be explained in greater detail with reference to a diagrammatic drawing of the principle of the structure of a piston.

Therein:

FIG. 1 shows a piston (1) in cross-section, with upper part (12) and lower part (13), ring wall (5), cooling duct (4), opening of the cooling duct (7), connecting rod bearing (8), connecting rod bearing wall (9) and combustion chamber recess (11).

One possible production variant for multipart pistons in this case is:

1) production of the piston upper part (12) from a forged steel, such as for example 25MoCr4, by forging, with the necessary mechanical and thermal properties in the region of the combustion chamber recess (11) being ensured.

2) production of the piston lower part (13) with connecting rod bearing (8) and piston skirt from high grade steel with a CTE of 13 to $20\times10^{-6}$/K by casting, in order to keep the gap between the piston skirt and cylinder barrel as small as possible during hot operation.

3) connection of the two piston parts by welding, in particular induction welding or friction welding.

Low pressure casting is particularly preferred as production method for the piston lower part.

In a further configuration of the invention, a combustion engine is provided which has steel pistons and in which the cylinder crankcase (CC) is formed from lightweight metal. In this case, cylinder crankcases, the sliding surfaces of which are formed by other materials, such as for example integrally cast cylinder bushings or wear-resisting layers, are also covered. The steel piston is formed, at least in the lower part, from a high grade steel with a high CTE in the range from 14 to $20\times10^{-6}$/K. In particular Al alloys are used as lightweight metal alloy.

The bushing body preferably consists of a high-strength aluminum alloy or of an aluminum alloy strengthened by strengthening means. The particularly suitable Al alloys include eutectic to hypoeutectic Al—Si alloys in particular from the range AlSi5 to AlSi11. Particularly preferred in this case are Al alloys with a relatively high Si content, such as for example AlSi11, AlSi10 or AlSi9, since the CTE as a rule decreases slightly with increasing Si content.

The sliding surface of the cylinder crankcase in this case may in known manner be formed by a slidable Al—Si alloy, metal composite material, anti-wear coating, or by gray cast iron. These may be part prefabricated as a separate cylinder liner or liner set and cast integrally into the bushing body made of lightweight metal alloy. For example, the cylinder crankcase may be constructed from an Al alloy or optionally also an Mg alloy, whereas the cylinder running surface is formed by an integrally cast cylinder liner of Al alloy, in particular Al—Si alloy, or gray cast iron alloy.

The metal composite materials are to be understood to be materials consisting of metal matrix, in particular of Al alloy, and of disperse phase of hard or wear resistant substances, in particular of silicon particles, ceramic particles or ceramic fibers. Suitable metal composite materials are for example known under the names Silitec®, or Lokasil®.

Particularly preferably, the sliding surface of the cylinder crankcase may be formed by an anti-wear coating consisting of a thermal sprayed layer or spray compacting layer on the cylinder liner or directly on the base material of the bushing body. It is particularly advantageous if in design terms the production of a separate cylinder liner can be dispensed with thereby. With this procedure, the adaptation of the CTE of the steel piston to the lightweight metal alloy of the bushing body, or of the cylinder crankcase, is particularly important, since only a thin anti-wear coating, or sprayed layer and not a virtually solid cylinder liner lies opposite the piston as sliding counterpart.

Thermal sprayed layers in accordance with the WAS method (wire arc spraying) based on iron alloys should be mentioned here as being particularly suitable. These are preferably applied directly to the inner wall of the cylinder bore made from an Al—Si alloy.

The cylinder crankcases in a monolithic construction in this case are produced for example from a hypereutectic Al—Si alloy, such as for example AlSi17Cu4Mg. The entire crankcase is preferably produced in a low pressure permanent mould process. From an economic point of view, the application is produced [sic] with a crankcase made from a hypoeutectic alloy, in particular an Al—Si alloy with Si<11%. Die casting is particularly advantageous.

The invention claimed is:

1. A combustion engine with
steel pistons with
a piston upper part (12) with a combustion chamber recess (11) and a ring wall (5), and
a piston lower part (13) with a piston body or piston skirt and with a connecting rod bearing (8) and
a cylinder crankcase made substantially of an aluminum alloy having a coefficient of thermal expansion at 20° C. in the range from 19 to $25\times10^{-6}$/K and having it's cylinder running surface formed as a thermally sprayed layer,
wherein the piston upper part consists of a wear-resistant alloyed heat treatment steel of the group MoCr4, 42CrMo4, CrMo4, 31CrMoV6 or 25MoCr4 and the piston lower part consists of a steel alloy which has a coefficient of thermal expansion at 20° C. in the range from 13 to $20\times10^{-6}$ 1/K, and
wherein the coefficient of thermal expansion of the piston lower part matches the coefficient of thermal expansion of the cylinder crankcase sufficiently to overcome piston slap.

2. The combustion engine as claimed in claim 1, wherein at least the steel alloy of the piston lower part has a coefficient of thermal expansion at 20° C. in the range from 15 to $19\times10^{-6}$ 1/K.

3. The combustion engine as claimed in claim 1, wherein at least the steel alloy of the piston lower part consists of a high grade steel with a Cr content of 15-26% and an Ni content of 8-15%.

4. The combustion engine as claimed in claim 3, wherein the piston upper part and piston lower part are joined together by friction welding, laser welding or induction welding.

5. The combustion engine as claimed in claim 1, wherein the aluminum alloy has a Si content in the range from 7 to 12% by weight.

6. A combustion engine with
steel pistons with
a piston upper part (12) with a combustion chamber recess (11) and a ring wall (5), and
a piston lower part (13) with a piston body or piston skirt and with a connecting rod bearing (8) and
a cylinder crankcase made substantially of an aluminum alloy having a coefficient of thermal expansion at 20° C. in the range from 19 to $25\times10^{-6}$/K and having it's cylinder running surface formed as a thermally sprayed layer directly applied to the inner wall of the cylinder bore made from an Al—Si alloy,
wherein the piston upper part consists of a wear-resistant alloyed heat treatment steel of the group MoCr4, 42CrMo4, CrMo4, 31 CrMoV6 or 25MoCr4 and the piston lower part consists of a steel alloy which has a coefficient of thermal expansion at 20° C. in the range from 13 to $20\times10^{-6}$ 1/K, and
wherein the coefficient of thermal expansion of the piston lower part matches the coefficient of thermal expansion of the cylinder crankcase sufficiently to overcome piston slap.

7. A combustion engine with
steel pistons with
a piston upper part (12) with a combustion chamber recess (11) and a ring wall (5), and
a piston lower part (13) with a piston body or piston skirt and with a connecting rod bearing (8) and
a cylinder crankcase made substantially of an aluminum alloy having a coefficient of thermal expansion at 20° C. in the range from 19 to $25\times10^{-6}$/K and having it's cylinder running surface formed as a thermally sprayed layer based on an iron alloy, which is directly applied to the inner wall of the cylinder bore made from an Al—Si alloy,
wherein the piston upper part consists of a wear-resistant alloyed heat treatment steel of the group MoCr4, 42CrMo4, CrMo4, 31 CrMoV6 or 25MoCr4 and the piston lower part consists of a steel alloy which has a coefficient of thermal expansion at 20° C. in the range from 13 to $20\times10^{-6}$ 1/K, and
wherein the coefficient of thermal expansion of the piston lower part matches the coefficient of thermal expansion of the cylinder crankcase sufficiently to overcome piston slap.

* * * * *